US009722294B2

(12) United States Patent
Chen et al.

(10) Patent No.: US 9,722,294 B2
(45) Date of Patent: Aug. 1, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Jin-Bo Chen, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 158 days.

(21) Appl. No.: 14/464,353

(22) Filed: Aug. 20, 2014

(65) Prior Publication Data

US 2015/0054694 A1 Feb. 26, 2015

(30) Foreign Application Priority Data

Aug. 22, 2013 (CN) ..... 2013 1 03672504

(51) Int. Cl.

| | |
|---|---|
| ***H01Q 1/24*** | (2006.01) |
| ***H01Q 1/12*** | (2006.01) |
| ***H01Q 9/04*** | (2006.01) |
| ***H01Q 5/378*** | (2015.01) |

(52) U.S. Cl.

CPC ..... *H01Q 1/1207* (2013.01); *H01Q 1/243* (2013.01); *H01Q 5/378* (2015.01); *H01Q 9/0421* (2013.01)

(58) Field of Classification Search

CPC ..... H01Q 1/243; H01Q 1/38; H01Q 9/0421; H01Q 1/42

USPC ..... 343/702, 872, 878, 700 MS

See application file for complete search history.

(56) References Cited

U.S. PATENT DOCUMENTS

| | | | | |
|---|---|---|---|---|
| 4,329,689 | A * | 5/1982 | Yee | H01Q 5/385 343/700 MS |
| 6,380,903 | B1 * | 4/2002 | Hayes | H01Q 1/243 343/700 MS |
| 6,421,011 | B1 * | 7/2002 | Van Egmond | H01Q 1/42 343/700 MS |
| 6,573,869 | B2 * | 6/2003 | Moore | H01Q 1/243 343/700 MS |
| 6,670,925 | B2 * | 12/2003 | Iwai | H01Q 9/0414 343/700 MS |
| 7,339,528 | B2 * | 3/2008 | Wang | H01Q 1/243 343/700 MS |
| 2004/0058723 | A1 * | 3/2004 | Mikkola | H01Q 1/243 455/575.7 |
| 2012/0188144 | A1 * | 7/2012 | Chen | H01Q 9/42 343/893 |

* cited by examiner

*Primary Examiner* — Dameon E Levi
*Assistant Examiner* — Collin Dawkins
(74) *Attorney, Agent, or Firm* — Steven Reiss

(57) ABSTRACT

An antenna structure includes a feed end, a first ground end, a first antenna, a second ground end, a second antenna, and a holder. The first antenna is connected to the feed end and the first ground end. The second antenna is a parasitic antenna, the second antenna is connected to the second ground end, and is opposite to the first antenna. The holder is connected between the first antenna and a second antenna.

10 Claims, 3 Drawing Sheets

ANTENNA STRUCTURE AND WIRELESS COMMUNICATION DEVICE USING THE SAME

FIELD

The disclosure generally relates to antenna structures, and particularly to an antenna structure having a metallic housing, and a wireless communication device using the same.

BACKGROUND

Antennas are used in wireless communication devices such as mobile phones. The wireless communication device uses a multiband antenna to receive/transmit wireless signals at different frequencies.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
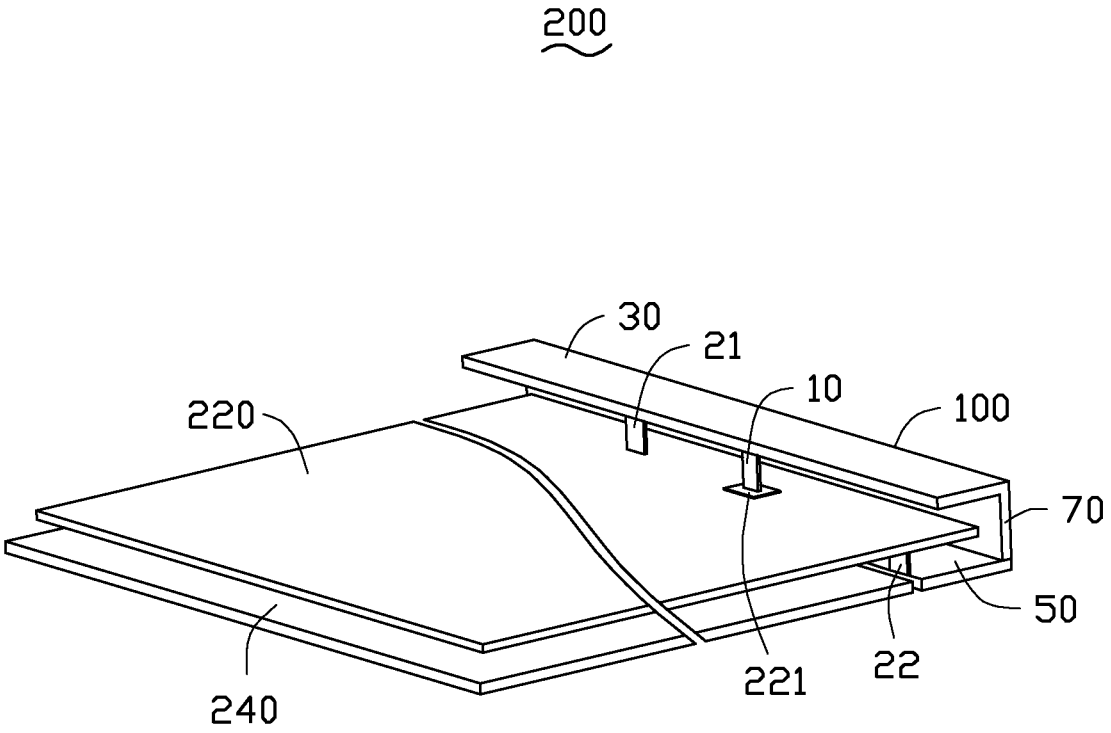
FIG. 1 is an isometric view of a wireless communication device employing an antenna structure, according to an exemplary embodiment.
Figure 2:
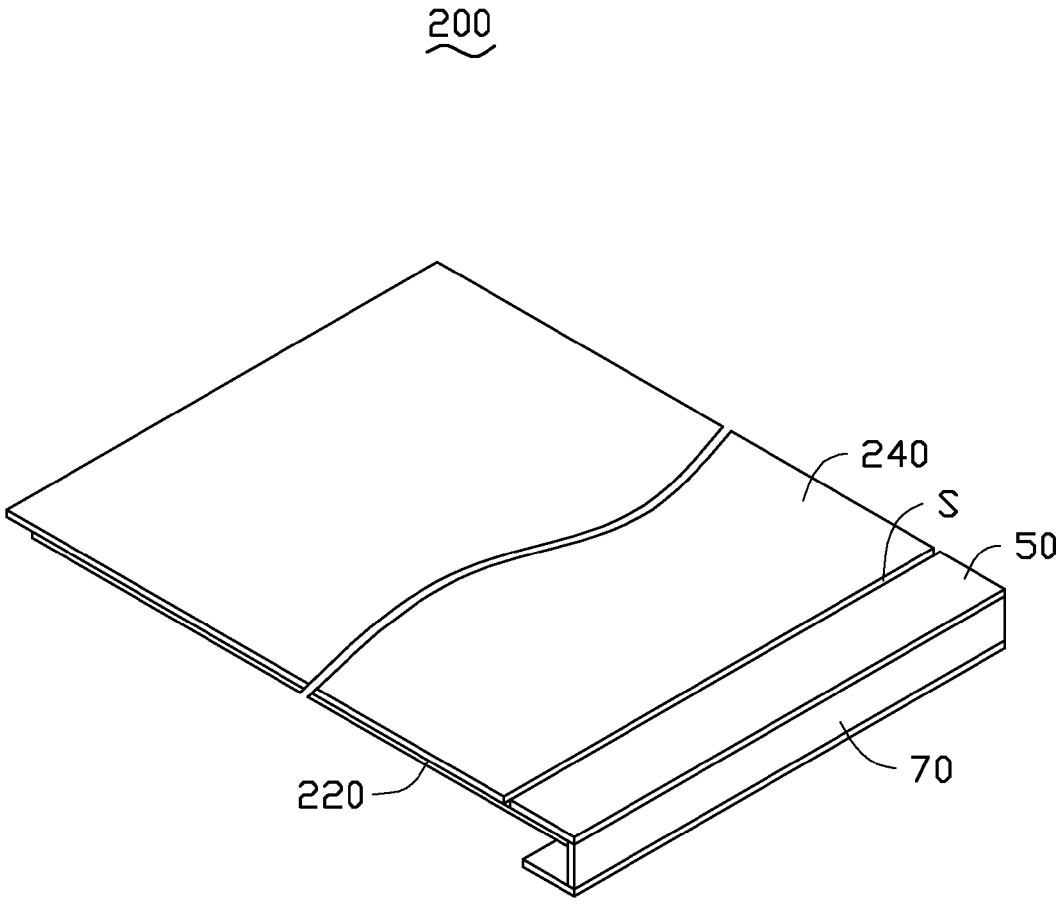
FIG. 2 is similar to FIG. 1, but shown from another aspect.

FIGS. 1-2 show an embodiment of a wireless communication device 200 employing an antenna structure 100, according to an exemplary embodiment. The wireless communication device 200 can be a mobile phone or a tablet, for example, depending on specific components (not shown) that would be added to the components shown in FIGS. 1-2.

Figure 3:
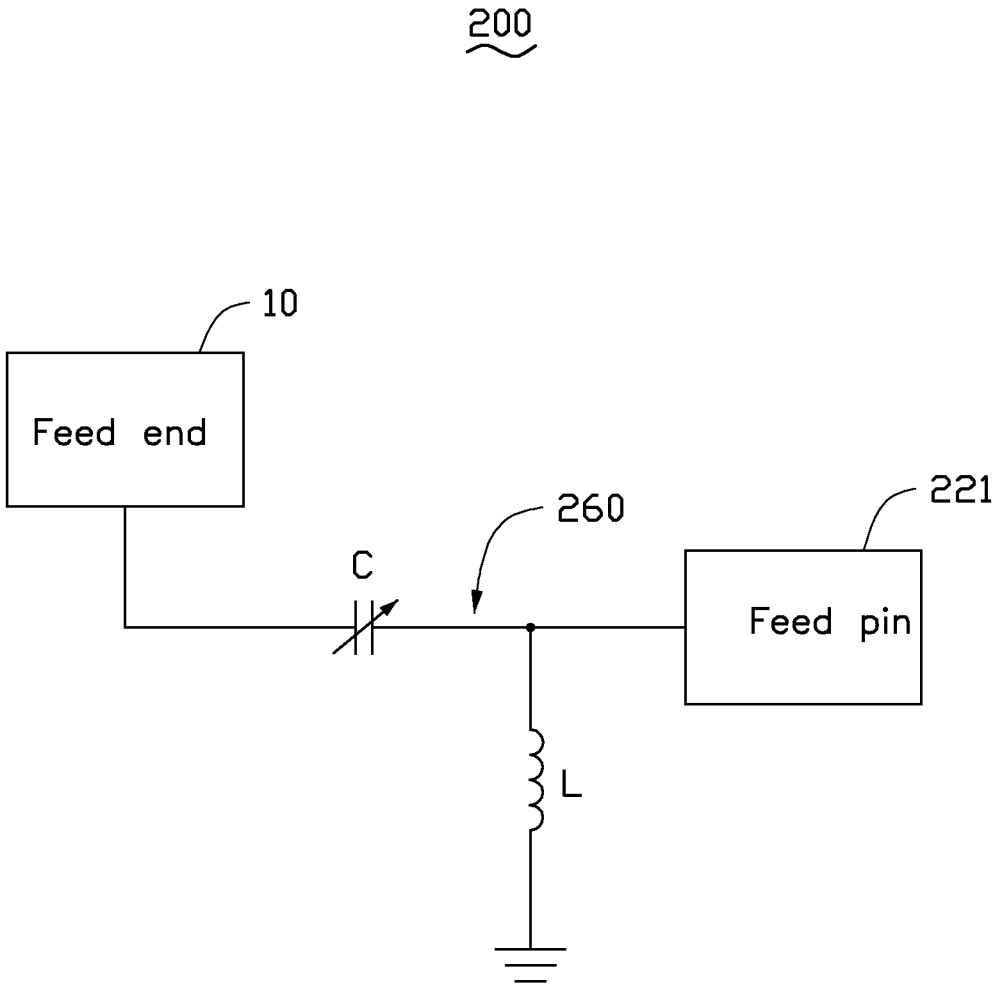
FIG. 3 is circuit view of a matching circuit of the antenna structure of FIG. 1.

The wireless communication device 200 further includes a printed circuit board (PCB) 220, a metal member 240, and a matching circuit 260 shown in FIG. 3. The PCB 220 forms a feed pin 221 and a ground plane distributed over the PCB 220. The metal member 240 can be a metallic frame of the wireless communication device 200. The antenna structure 100 includes a feed end 10, a first ground end 21, a second ground end 22, a first antenna 30, a second antenna 50, and a holder 70. The feed end 10 is coupled to the feed pin 221, and the first ground end 21 and the second ground end 22 are coupled to the ground plane.

The metal member 240 is located at a first side of the PCB 220, and is coupled to the ground plane of the PCB 220. In one exemplary embodiment, the metal member 240 is a rectangular board. The second antenna 50 is configured as a metallic housing of the wireless communication device 200. The second antenna 50 is substantially coplanar with the metal member 240, and a gap S is defined between the second antenna 50 and the metal member 240. An insulation material, such as a rubber, can be filled in the gap S for physically connecting the second antenna 50 to the metal member 240. In addition, the second antenna 50 and the metal member 240 are isolated from each other by the insulation material.

The first antenna 30 can be a rectangular board, and a length of the first antenna 30 is substantially equal to a length of the PCB 220. The first antenna 30 is located at a second side of the PCB 220, and is adjacent to a distal end of the PCB 220. The first antenna 30 is connected to the feed end 10 and the ground end 21. Current flowing on the first antenna 30 can be adjusted by changing a position of the first antenna 30 relative to the feed end 10 and the ground end 21, thereby receiving and transmitting wireless signals having a first central frequency. In at least one embodiment, a dimensions of the second antenna 30 is about 68 mm*7 mm.

The second antenna 50 is a parasitic antenna because the second antenna 50 is not directly connected to the feed pin 221 and instead is coupled to the feed pin 221 through the first antenna 30. In one exemplary embodiment, the second antenna 50 is a rectangular board, and a length of the second antenna 50 is substantially equal to a width of the PCB 220. The second antenna 50 is located at the first side of the PCB 220, and is opposite to the first antenna 30. The second antenna 50 is connected to the second ground end 22. Current flowing on the first antenna 50 can be adjusted by changing a position of the second antenna 50 relative to the second ground end 22, thereby receiving and transmitting wireless signals having a second central frequency. In at least one embodiment, a dimensions of the second antenna 50 is about 68 mm*10 mm.

The holder 70 is made of insulation materials. In one exemplary embodiment, the holder 70 is a rectangular board, and is substantially and perpendicularly connected between the first antenna 30 and the second antenna 50, for cooperatively defining a receiving space to receive the distal end of the PCB 220. In one exemplary embodiment, the holder 70 is connected to a side of the first antenna 30 opposite to the feed end 10, and is connected to a side of the second antenna 50 opposite to the second ground end 22.

FIG. 3 illustrates the matching circuit 260 of the wireless communication device 200. The matching circuit 260 is electronically connected between the antenna structure 100 and the PCB 220. The matching circuit 260 includes a capacitor C and an inductor L. The feed end 10 of the antenna structure 100 is electronically connected to the feed pin 221 via the capacitor C. A first end of the inductor L is electronically connected between the capacitor C and the feed pin 221, and a second end of the inductor L is connected to ground. The capacitor C is an adjustable capacitor, and is configured to optimize performance of the antenna structure 100. In at least one embodiment, a capacitance value of the capacitor C is about 0~8 pF, and an inductance value of the inductor L is about 4.3~7.5 nH.

When current is input to the feed end 10 from the PCB 220, the current flows to the first antenna 30, and is grounded via the ground end 21. Thus, the first antenna 30 is activated to receive and transmit wireless signals at a first bandwidth, which can be for example about 1710-1900 MHZ. Additionally, the second ground end 22 receives the current from the ground plane of the PCB 220, and then the second antenna 50 is activated to receive and transmit wireless signals at a second bandwidth, which can be for example about 1900-2690 MHZ. Furthermore, an impedance of the first antenna 30 is adjusted by the matching circuit 260 to allow the first antenna 30 to receive and transmit wireless signals at a third bandwidth, which can be for example about 704-746 MHz or 824-960 MHZ.

In summary, the second antenna 50 is served as a metallic housing of the wireless communication device 200. Thus, the wireless communication device 200 does not need to employ any additional antennas, which can effectively utilize a space of the wireless communication device 200. In addition, a radiating capability of the antenna structure 100 of the wireless communication device 200 is effectively improved because of the matching circuit 260.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:
a feed end;
a first ground end;
a first antenna connected to the feed end and the first ground end;
a second ground end;
a second antenna being a parasitic antenna coupled to the feed end through the first antenna, the second antenna being connected to the second ground end, and opposite to the first antenna; and
a holder connecting the first antenna to the second antenna;
wherein the holder is connected to a side of the first antenna opposite to the feed end, and is connected to a side of the second antenna opposite to the second ground end;
wherein the holder is made of insulation materials.

2. A wireless communication device, comprising:
a printed circuit board (PCB); and
an antenna structure located at an end of the PCB, the antenna structure comprising:
a feed end;
a first ground end;
a first antenna connected to the feed end and the first ground end;
a second ground end;
a second antenna being a parasitic antenna coupled to the feed end through the first antenna, the second antenna being connected to the second ground end, and opposite to the first antenna; and
a holder connected between the first antenna and a second antenna;
wherein the holder is connected to a side of the first antenna opposite to the feed end, and is connected to a side of the second antenna opposite to the second ground end;
wherein the holder is made of insulation materials.

3. The wireless communication device as claimed in claim 2, wherein the first antenna and the second antenna are located at two opposite sides of the PCB.

4. The wireless communication device as claimed in claim 3, wherein the holder, the first antenna, and the second antenna cooperatively define a receiving space to receive a distal end of the PCB.

5. The wireless communication device as claimed in claim 2, further comprising a matching circuit, wherein the matching circuit comprises a capacitor and an inductor, the feed end of the antenna structure is electronically connected to a feed pin formed on the PCB via the capacitor, a first end of the inductor is electronically connected between the capacitor and the feed pin, and a second end of the inductor is connected to ground.

6. The wireless communication device as claimed in claim 5, wherein the capacitor is an adjustable capacitor.

7. The wireless communication device as claimed in claim 2, further comprising a metal member located at a side of the PCB, wherein the second antenna is substantially coplanar with the metal member, and a gap is defined between the second antenna and the metal member.

8. The wireless communication device as claimed in claim 7, wherein both of the second antenna and the metal member are served as a metallic housing of the wireless communication device.

9. A wireless communication device, comprising:
a printed circuit board (PCB) comprising a feed pin and a ground plane; and
an antenna structure located at an end of the PCB, the antenna structure comprising:
a feed end electronically connected to the feed pin;
a first ground end electronically connected to the ground plane;
a first antenna electronically connected to the feed end and the first ground end;
a second ground end electronically connected to the ground plane;
a second antenna connected to the second ground end; and
a holder connecting the first antenna to the second antenna;
wherein the holder is connected to a side of the first antenna opposite to the feed end, and is connected to a side of the second antenna opposite to the second ground end;
wherein the holder is made of insulation materials;
a metal member located at a side of the PCB;
wherein the second antenna is substantially coplanar with the metal member, and a gap is defined between the second antenna and the metal member.

10. The wireless communication device as claimed in claim 9, wherein both of the second antenna and the metal member are served as a metallic housing of the wireless communication device.

* * * * *